US008192291B2

(12) United States Patent
Brassard et al.

(10) Patent No.: US 8,192,291 B2
(45) Date of Patent: Jun. 5, 2012

(54) WATERSLIDE BOWL WITH TROUGHS

(75) Inventors: Daniel P. Brassard, Vancouver (CA); Marvin R. Hlynka, Richmond (CA)

(73) Assignee: Whitewater West Industries Ltd. (CA)

( * ) Notice: Subject to any disclaimer, the term of this patent is extended or adjusted under 35 U.S.C. 154(b) by 180 days.

(21) Appl. No.: 12/395,267

(22) Filed: Feb. 27, 2009

(65) Prior Publication Data

US 2009/0239671 A1 Sep. 24, 2009

Related U.S. Application Data

(63) Continuation-in-part of application No. 12/038,896, filed on Feb. 28, 2008, now Pat. No. 7,887,426.

(51) Int. Cl.
*A63G 21/18* (2006.01)
*A63G 21/00* (2006.01)

(52) U.S. Cl. ..... 472/117; 472/128; 104/69

(58) Field of Classification Search ..... 472/13, 472/88–91, 116–117, 128, 129; 104/69–70
See application file for complete search history.

(56) References Cited

U.S. PATENT DOCUMENTS

| | | | | |
|---|---|---|---|---|
| 4,196,900 | A | 4/1980 | Becker et al. | |
| 4,198,043 | A | 4/1980 | Timbes et al. | |
| D269,105 | S * | 5/1983 | Brown | D21/819 |
| 4,429,867 | A | 2/1984 | Barber | |
| 4,790,531 | A * | 12/1988 | Matsui et al. | 472/90 |
| 4,910,814 | A * | 3/1990 | Weiner | 4/488 |
| 5,433,671 | A * | 7/1995 | Davis | 472/117 |
| 6,450,891 | B1 | 9/2002 | Dubeta | |
| 6,485,372 | B2 | 11/2002 | Stuart et al. | |
| 6,527,646 | B1 | 3/2003 | Briggs | |
| 6,939,236 | B2 * | 9/2005 | McLaren et al. | 472/90 |
| D521,098 | S | 5/2006 | Hunter | |
| 7,056,220 | B2 | 6/2006 | Hunter | |
| D548,810 | S | 8/2007 | Hunter | |
| D583,895 | S | 12/2008 | Hlynka | |
| 2009/0062025 | A1 | 3/2009 | Hlynka | |

FOREIGN PATENT DOCUMENTS

| | | |
|---|---|---|
| AU | 524315 | 11/1980 |
| GB | 2 224 948 | 5/1990 |

* cited by examiner

*Primary Examiner* — Kien Nguyen
(74) *Attorney, Agent, or Firm* — Greenberg Traurig

(57) ABSTRACT

A waterslide bowl has a fixed rider path from entrance to exit. The bowl comprises a trough which is made of a plurality of sets of trough sections, attached together, in which the trough sections of a given set are the same and nest together side-by-side, permitting the rider surface of the bowl to be made from trough sections having a small number of different shapes. This reduces the number of molds that would otherwise be required to make the trough sections. The waterslide bowl may also have two or more separate troughs, nested together, whereby the bowl may be ridden in by multiple riders at the same time, each in his or her own trough.

9 Claims, 17 Drawing Sheets

WATERSLIDE BOWL WITH TROUGHS

CROSS-REFERENCE TO RELATED APPLICATION

This is a continuation-in-part of prior application Ser. No. 12/038,896, filed Feb. 28, 2008.

TECHNICAL FIELD OF THE INVENTION

The invention pertains to waterslides, and, in particular, to waterslide bowls having one or more troughs to guide riders from the entrance of the bowl to its exit.

BACKGROUND OF THE INVENTION

In the art of waterslide design, it is known to include a bowl as one element of a waterslide apparatus. Such bowls are typically configured so that the rider enters the bowl through a flume on a tangential trajectory and slides around the bowl in a generally spiral path before exiting through an opening at the bottom of the bowl. Examples of such waterslide bowls are disclosed in Stuart et al., U.S. Pat. No. 6,485,372 and GB 2,224,948.

In conventional waterslide bowls, riders do not follow a fixed path in the bowl because there is no guiding structure on the rider surface of the bowl. The causes inconsistent performance: a rider may go around the bowl once, twice or more times. Since the rider capacity of a waterslide is limited by the maximum length of time it takes a rider to traverse the waterslide, variability in the length of time that riders spend traversing the bowl reduces the capacity of the waterslide. A fixed path in the bowl would make the rider's experience of the ride, and the duration of the ride, more uniform.

One possible approach to this problem is to mold a continuous trough in the bottom of the bowl to guide the rider from the bowl entrance to its exit in a fixed, approximately spiral path. However, since waterslide bowls are conventionally made by attaching together molded pie-shaped segments, a large number of individually-shaped segments would be required to create such trough by such molding method.

Another possible approach is to have elements in the bowl that form a partial trough which captures the riders and guides them to the exit. However, that may introduce a hazard in the form of a fin or edge that divides adjacent parts of the trough.

SUMMARY OF THE INVENTION

The invention provides a waterslide bowl which comprises a trough made of trough sections which connect to each other end-to-end to form a fixed rider path. The sections may nest together in a side-by-side arrangement.

The invention further provides a waterslide bowl comprising two or more troughs, each of which is made of trough sections which connect end-to-end to form respective rider paths. The troughs may nest together in a side-by-side arrangement.

The invention further provides a waterslide bowl comprising at least two parallel troughs, the troughs comprising a plurality of trough sections. The parallel troughs are curved or at least partially curved. Each trough section comprises a part of the at least two parallel troughs. The trough sections connect to each other end-to-end to form fixed rider paths and nest together in a side-by-side arrangement.

The invention further provides a waterslide bowl that has at least one fixed rider path from entrance to exit. The bowl comprises at least one trough which is made of sets of trough sections, attached together, in which the trough sections of a given set may be the same, permitting the rider surface of the bowl to be made from trough sections having a relatively small number of different shapes. This reduces the number of molds that would otherwise be required to make the trough sections and accordingly reduces fabrication costs. The waterslide bowl may comprise a single trough, or it may comprise two or more troughs which nest together.

The invention further provides a waterslide bowl which comprises one or more troughs made of trough sections which are connected to each other end-to-end to form one or more fixed rider paths. Some of the trough sections may have a width different from others of the trough sections. Some of the trough sections are curved and some may be straight, such that the bowl can be various shapes, including circular, race-track-shaped, rectangular with rounded corners, and other shapes. The bowl may have two or more troughs which may be equal in width or have different widths.

The invention further provides an inverted waterslide bowl comprising a trough to guide a rider in a fixed path from a rider entrance to a rider exit. The inverted bowl has a center at a higher elevation than its periphery, the rider entrance being proximate to the center of the inverted bowl and the rider exit being proximate to the periphery.

According to one embodiment of the invention, in which the bowl has a single trough, there is provided a waterslide bowl comprising a rider entrance, a rider exit and a trough to guide the rider in a fixed path from the entrance to the exit. The trough has a width W and comprises sets of trough sections, each set comprising one or more of the trough sections. Each set forms one half of a circle and has a respective radius. The sets comprise an inner set adjacent to the rider exit, an outer set, and one or more intermediate sets between the inner and outer sets. The radius of each set that is outward from the inner set is larger than the radius of a respectively adjacent inward set by a distance of W/2.

According to another embodiment of the invention, in which the bowl has single trough, there is provided a waterslide bowl comprising a rider entrance, a rider exit and a trough to guide a rider in a fixed path from the entrance to the exit. The trough has a width W and comprises a plurality of sets of trough sections. Each set forms one half of a circle and has a respective radius. A first set of trough sections is adjacent to the rider exit and has a radius A. A second set of trough sections is contiguous with the first set and has a radius B approximately equal to A plus W/2. A third set of trough sections is contiguous with the second set and has a radius C approximately equal to B plus W/2.

According to a further embodiment of the invention, there is provided a waterslide bowl comprising a rider entrance, a rider exit and a trough to guide a rider in a fixed path from the entrance to the exit. The trough comprises a plurality of sets of trough sections, each set forming one half of a circle and having a respective radius. The sets comprise an inner set adjacent to the rider exit, an outer set adjacent to the rider entrance and one or more intermediate sets between the inner and outer sets. The radius of the one-half circle formed by each respective set that is outward from the inner set is larger than the radius of an adjacent inward set such that the fixed path is a continuous curved path.

According to a further embodiment of the invention, there is provided a waterslide bowl having two troughs which nest together in a side-by-side arrangement, each trough having its own rider entrance and exit, whereby two riders can use the bowl at the same time, each in a separate trough. The first trough comprises sets of trough sections, each set forming one-half of a circle and having a respective radius, the sets comprising an inner set adjacent to the first rider exit, an outer set adjacent to the first rider entrance and one or more intermediate sets, the radius of each respective set that is outward from the inner set being larger than the radius of an adjacent inward set such that the fixed path is a continuous curved path. The radius of each set that is outward from the inner set may be larger than the radius of a respectively adjacent inward set by a distance of about W. The second trough has substantially the same configuration, such that the two troughs fit together to form a rider surface of the bowl.

According to a further embodiment of the invention, there is provided a waterslide bowl having three or more troughs which nest together in a side-by-side arrangement, each trough having its own rider entrance and exit, whereby three or more riders can use the bowl at the same time, each in a separate trough. Each trough has a width W and comprises sets of trough sections. Each set forms a fraction of a circle and has a respective radius, the fraction being 1/X, where X is the number of troughs that comprise the bowl. Each of the sets of a respective trough comprises an inner set, and one or more sets that are outward from the inner set, the respective radius of each set that is outward from the respective inner set being larger than the radius of a respectively adjacent inward set by a distance of about W.

The invention also provides a method of making a waterslide bowl having a trough to guide a rider in a fixed path from a rider entrance to a rider exit. A first set of trough sections is provided, the sections of the first set being substantially the same as each other, the first set forming a fraction of a circle having a first radius. A second set of trough sections is provided, the sections of the second set being substantially the same as each other, the second set forming a fraction of a circle having a second radius, the second radius being larger than the first radius. The two sets are assembled together, with or without an intervening straight section, to form the trough. Other trough sections, which may include curved and straight sections, are added to complete the waterslide bowl.

According to one embodiment of the method of the invention, a first set of trough sections is provided, the sections having a width W, the first set forming one-half of a circle having a first radius. A second set of trough sections is provided, the sections of the second set having the same width W, the second set forming one-half of a circle having a second radius. The second radius is larger than the first radius by a distance equal to or greater than W/2. The two sets are assembled to form the trough. Other trough sections may be added to complete the bowl.

These and other features of the invention will be apparent from the following description and drawings of the preferred embodiments.

DESCRIPTION OF THE PREFERRED EMBODIMENTS

Figure 1:
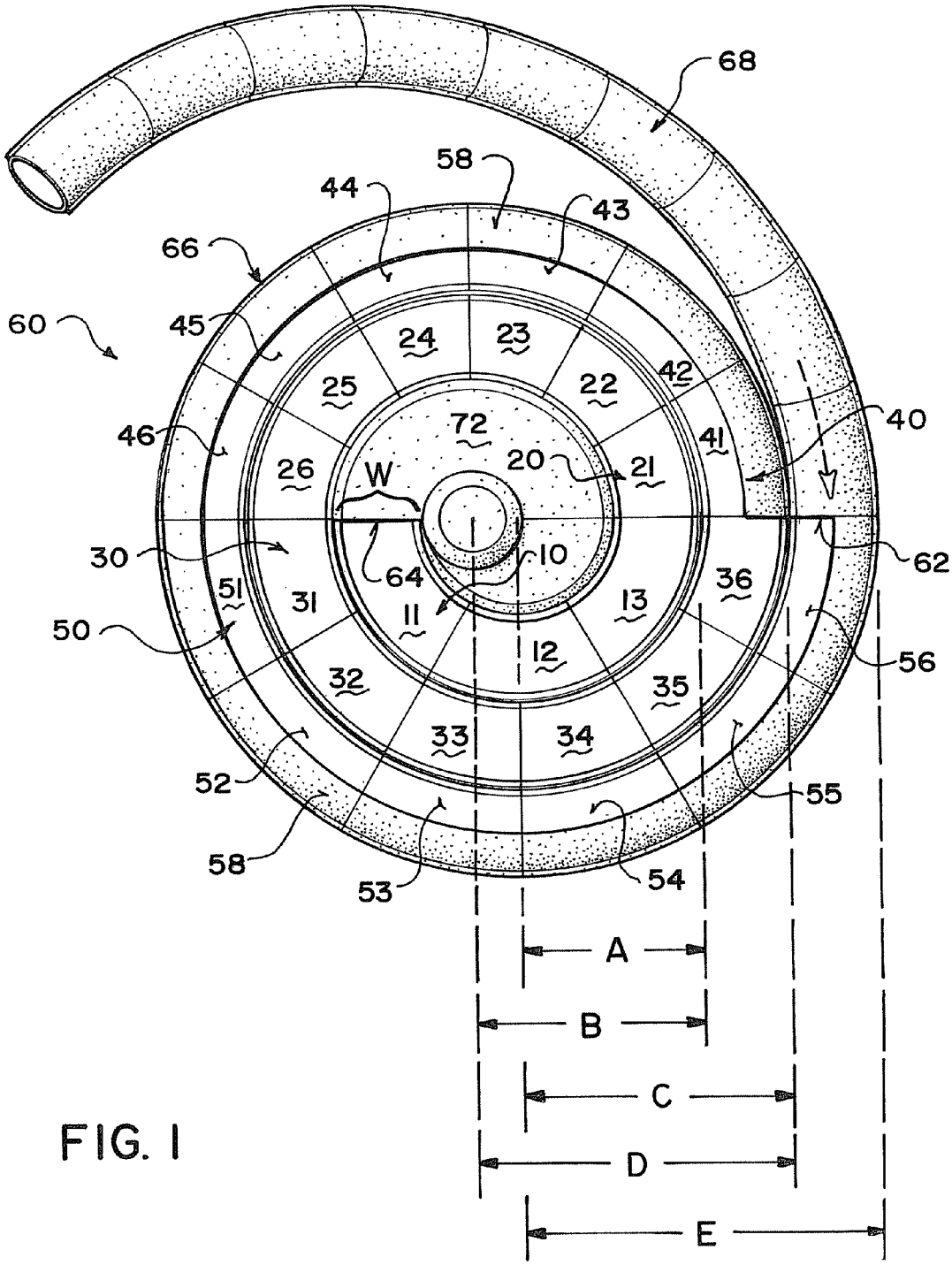
FIG. 1 is a top plan view of one embodiment of a waterslide bowl, having one trough.
Figure 2:
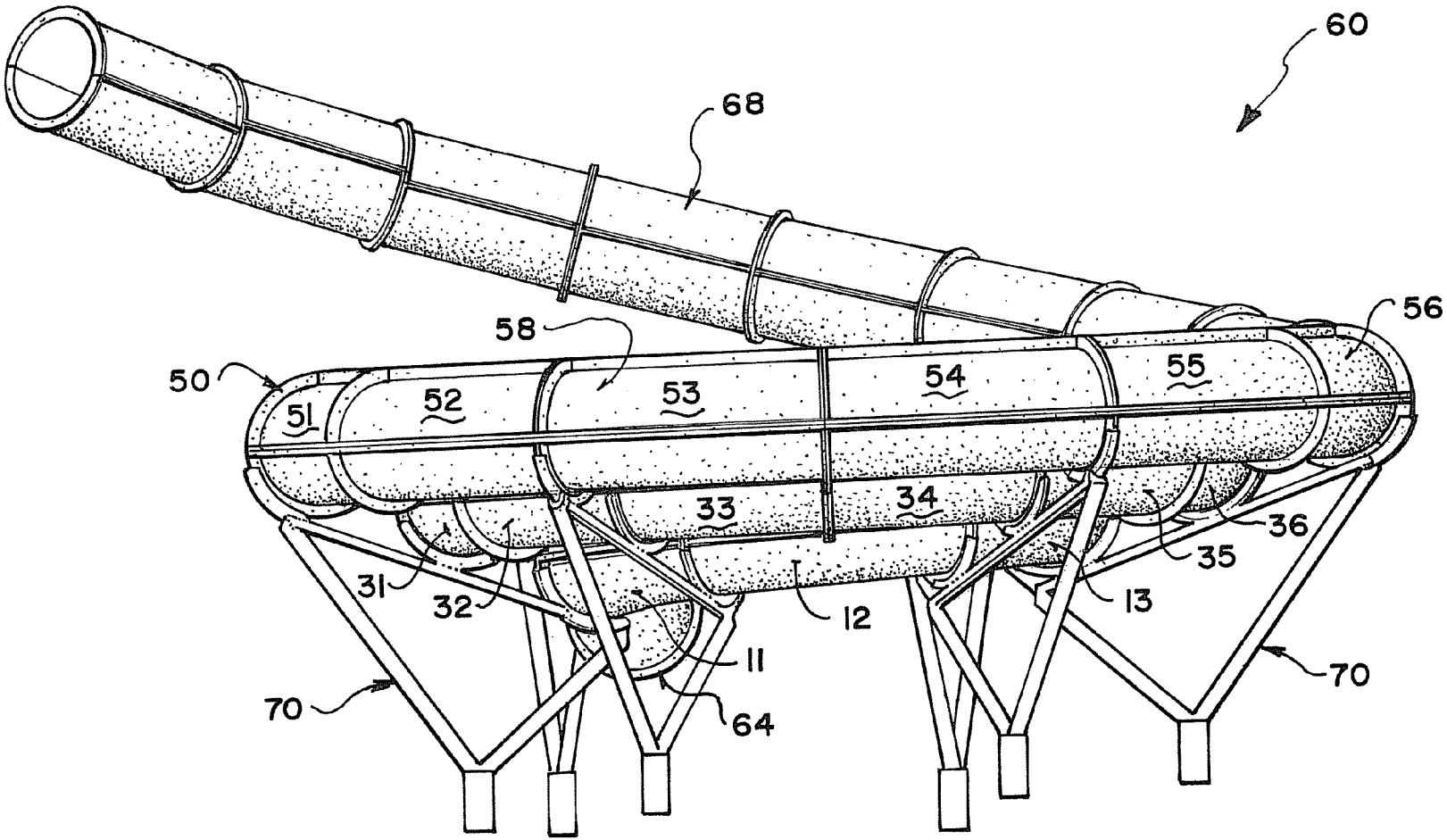
FIG. 2 is a side elevation view of the waterslide bowl of FIG. 1.

In the following description and drawings, corresponding and like parts are referred to by the same reference numerals. For convenience of explanation, preferred embodiments of the invention are categorized and set forth below according to the number of troughs that comprise the bowl. It will be seen, however, that the various bowls are alike in overall structure, with the rider entrance(s) at the outer perimeter of the bowl and the rider exit(s) at or near the center, at an elevation lower than the entrance (apart from the inverted bowl embodiments), with the sections of the troughs nesting side-by-side to collectively form the bowl, and with each trough forming a fixed rider path from the entrance to the exit which continuously curves or includes some straight sections, the whole being supported above a floor or the like by bowl supports. The waterslide bowls can be used by a rider with or without a ride-on device such as a mat, tube or raft. Ride-on devices can carry one or more riders.

Single-Trough Bowls

Referring first to FIGS. 1 to 4, the waterslide bowl 60 has a rider entrance 62, a rider exit 64 and a trough 66 extending in a continuous, curved path between the entrance and the exit. The trough 66 forms the rider surface of the bowl. The bowl 60 is roughly circular with the entrance 66 being at its outer edge and the exit 64 being near the center and at a lower elevation than the entrance. The path described by the trough 66 is accordingly a fixed, continuously curving path that is roughly spiral, and descends from a relatively higher elevation at the entrance 62 to a relatively lower elevation at the exit 64. The bowl 60 is supported on a floor by the bowl supports 70.

The bowl 60 is one component of a waterslide apparatus. A flume 68 leading from an upstream part of the waterslide apparatus (not shown in the drawings) is affixed to the bowl 60 at the rider entrance 62. A rider descends through the flume 68 and enters the bowl 60 through the rider entrance 62. After traversing the bowl, the rider exits the bowl through the exit 64, which leads by a flume or slide to downstream elements of the waterslide apparatus or to a pool, mat, or other soft landing element which terminates the ride.

The trough 66 is made of a plurality of sets of individual trough sections. In the illustrated embodiment, there are five such sets, designated as 10, 20, 30, 40 and 50. The first set is the innermost set in the bowl, being adjacent to and leading into the rider exit 64. It comprises three trough sections 11, 12 and 13. Each trough section is an individual component, the sections being affixed together to form a set. The set 10 of trough sections 11, 12 and 13 forms a half-circle which has a radius designated A in FIG. 1.

The second set 20 of trough sections continues the trough 66 outwardly in the bowl from the first set 10, and comprises six trough sections 21, 22, 23, 24, 25 and 26. This set 20 forms a half-circle which has a radius designated B in FIG. 1. All of the trough sections of the bowl have the same width, designated W in FIG. 1. The radius B is longer than the radius A by a distance of W/2. It will be apparent that the diameter of the half-circle formed by the second set 20 of trough sections is greater than the diameter of the half-circle formed by the first set 10 of trough sections by a distance equal to W. The first set 10 and the second set 20 of trough sections fit around and nest against the center member 72 of the bowl.

The third set 30 of trough sections continues the trough 66 outwardly in the bowl 60 from the second set 20, and comprises six trough sections 31, 32, 33, 34, 35 and 36. This set 30 of trough sections forms a half-circle which has a radius designated C in FIG. 1. The radius C is longer than the radius B by a distance of W/2. The diameter of the half-circle formed by the third set 30 of trough sections is therefore greater than the diameter of the half-circle formed by the second set 20 of trough sections by a distance equal to W. The third set 30 of accordingly fits around and nests against the first set 10 of trough sections.

The fourth set 40 of trough sections continues the trough 66 outwardly in the bowl 60 from the third set 30, and comprises six trough sections 41, 42, 43, 44, 45 and 46. The set 40 of trough sections forms a half-circle which has a radius designated D in FIG. 1. The radius D is longer than the radius C by a distance of W/2. The diameter of the half-circle formed by the fourth set 40 of trough sections is therefore greater than the diameter of the half-circle formed by the third set 30 of trough sections by a distance equal to W. The fourth set 40 accordingly fits around and nests against the second set 20 of trough sections.

The fifth set 50 of trough sections continues the trough 66 outwardly in the bowl 60 from the fourth set 40 to the rider entrance 62, and comprises six trough sections 51, 52, 53, 54, 55 and 56. This set 50 of trough sections forms a half-circle which has a radius designated E in FIG. 1. The radius E is longer than the radius D by a distance of W/2. The diameter of the half-circle formed by the fifth set 50 of trough sections is therefore greater than the diameter of the half-circle formed by the fourth set 40 of the trough sections by a distance equal to W. The fifth section accordingly fits around and nests against the third set 30 of trough sections.

Figure 3:
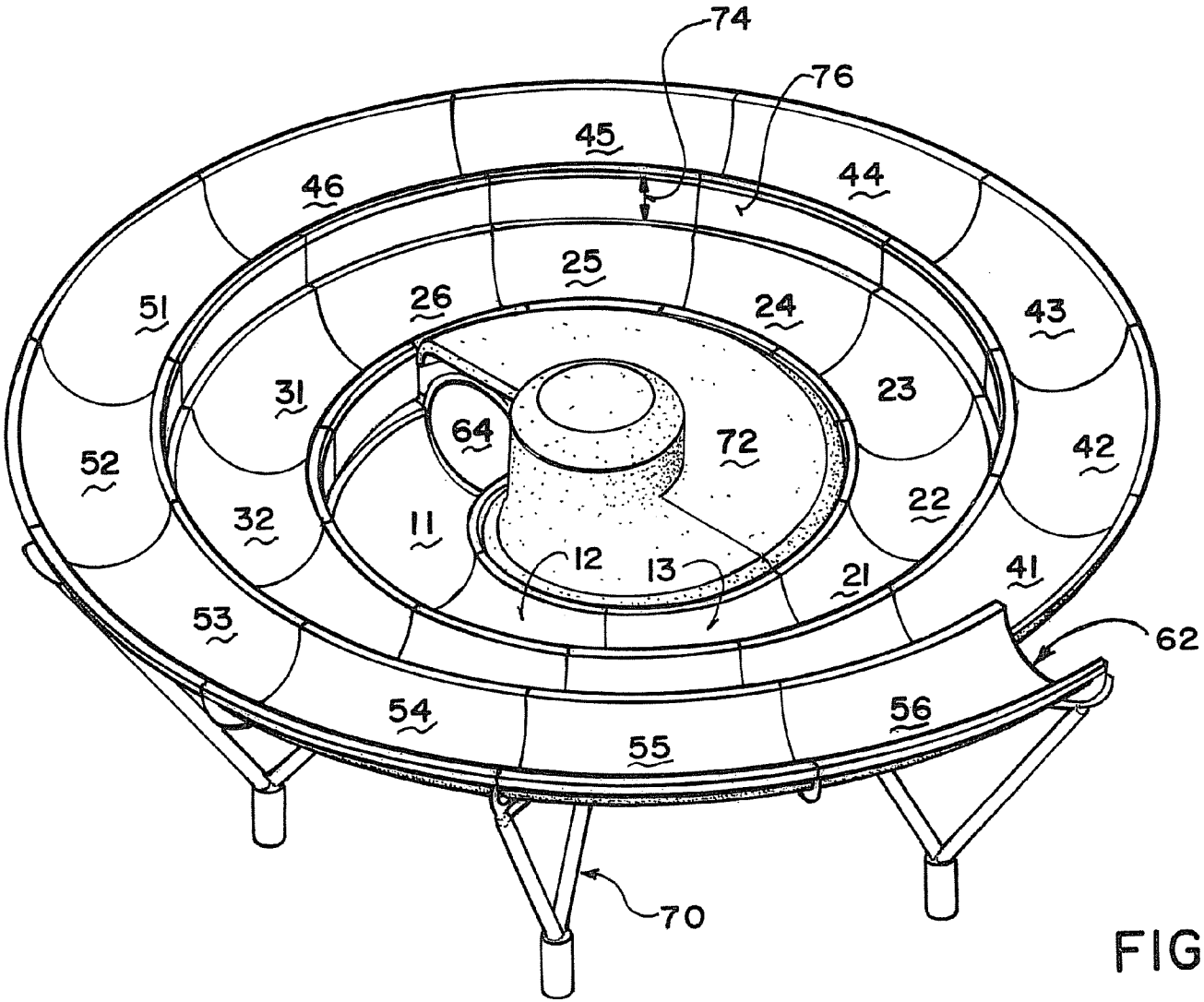
FIG. 3 is a perspective view of the waterslide bowl of FIG. 1, without the entrance flume.
Figure 4:
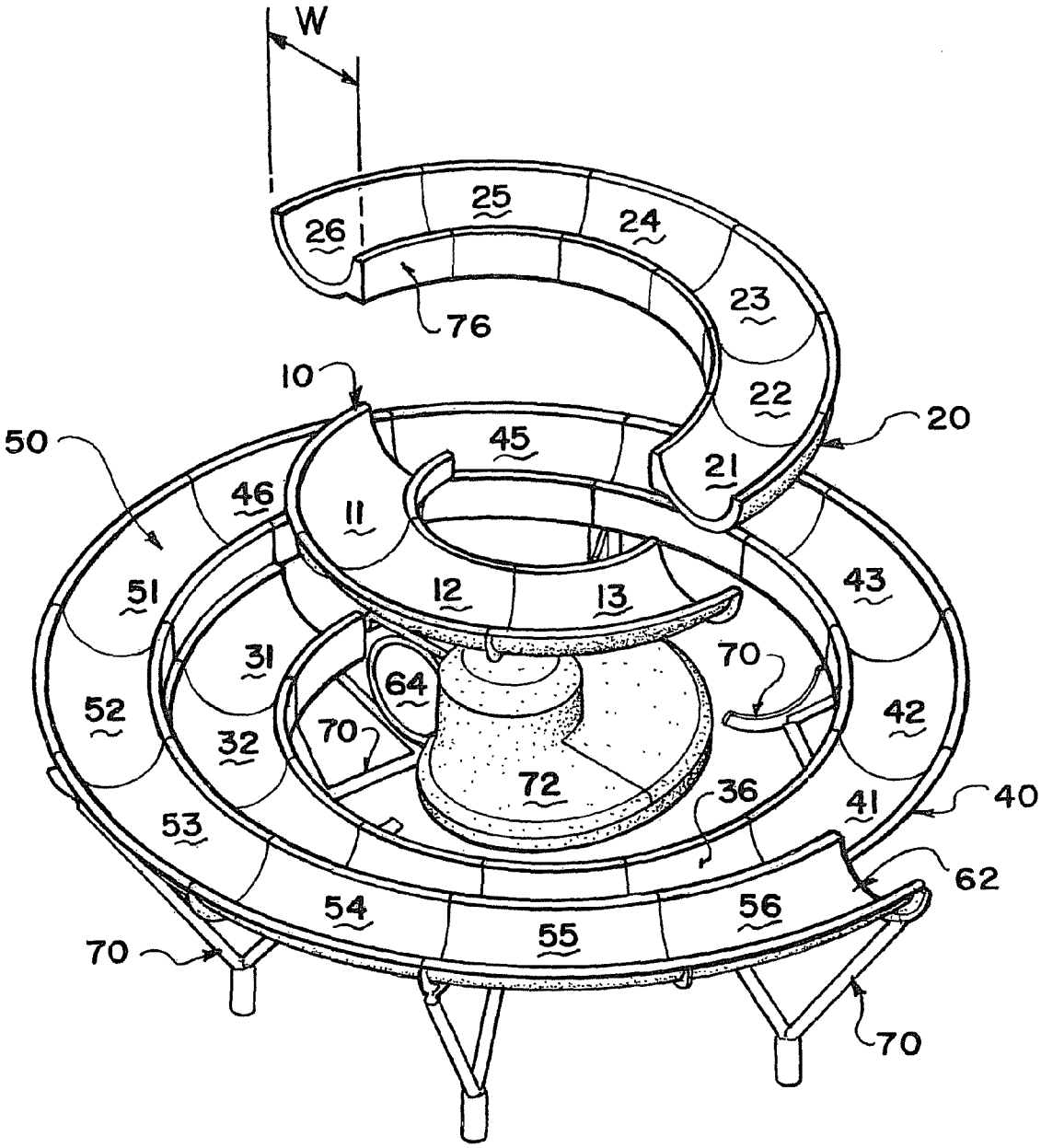
FIG. 4 is a perspective view of the waterslide bowl of FIG. 1, without the entrance flume, showing the bowl partially disassembled, with two sets of trough sections separated from the bowl.

As best seen in FIG. 3, due to the vertical descent of the trough going from the entrance to the exit, a vertical gap 74 is formed between the edges of radially-adjacent trough sections. This gap 74 corresponds to the height of the outer wall 76 of the trough sections (best seen in FIG. 4). The gap may optionally be covered by suitable detail pieces (not shown) so that the inner surface of the bowl is unbroken and smooth.

The trough sections of a given set are substantially identical to each other in shape and size. For example, each of trough sections 11, 12 and 13 are the same as each other; and each of trough sections 21, 22, 23, 24, 25 and 26 are the same as each other; and so on for the other sets. As a result, the riding surface of the trough 66 can be made from only five different shapes of trough sections. The trough sections can be made of molded plastics material such as, for example, fiberglass, so only five different molds are required to form the trough sections.

An upwardly-extending sidewall 58 is provided on the outer side of sets 40 and 50 of the trough sections to retain the rider in the trough after entering the bowl. For clarity of illustration, the sidewall is not shown in FIGS. 3 and 4.

Representative dimensions of the bowl 60 are as follows. In one embodiment, the outer diameter of the outer set of trough sections is 13.695 m. The vertical drop from the rider entrance to exit is 1.592 m. The width of the trough is 1.676 m. The radii of the half-circles formed by the five sets of trough sections, from inner to outer, are respectively 2.662 m, 3.500 m, 4.338 m, 5.175 m and 6.013 m.

It will be apparent that the waterslide bowl can be made larger or smaller than the illustrated bowl 60, providing more or fewer revolutions about the bowl for a rider, by having more or fewer sets of trough sections. For example, the bowl could be made smaller, providing a path one revolution less around the bowl, by omitting the outer sets 40 and 50 and affixing the flume 68 to trough section 36. Similarly, the bowl could be made larger, providing a path, for example, one-half revolution longer around the bowl, by adding an additional set of trough sections to continue the path outward from trough section 56, the additional set forming a half-circle with a radius longer than the radius E of the half-circle formed by the set 50 by a distance equal to W/2.

The modular construction of the bowl permits the rider entrance and the rider exit of the bowl to be located at any selected radial position. For example, referring to the FIG. 1 orientation, the rider entrance could be located at the six o'clock position rather than the 3 o'clock position by omitting the outer three trough sections 54, 55 and 56, and attaching the flume 68 to trough section 53.

Figure 13:
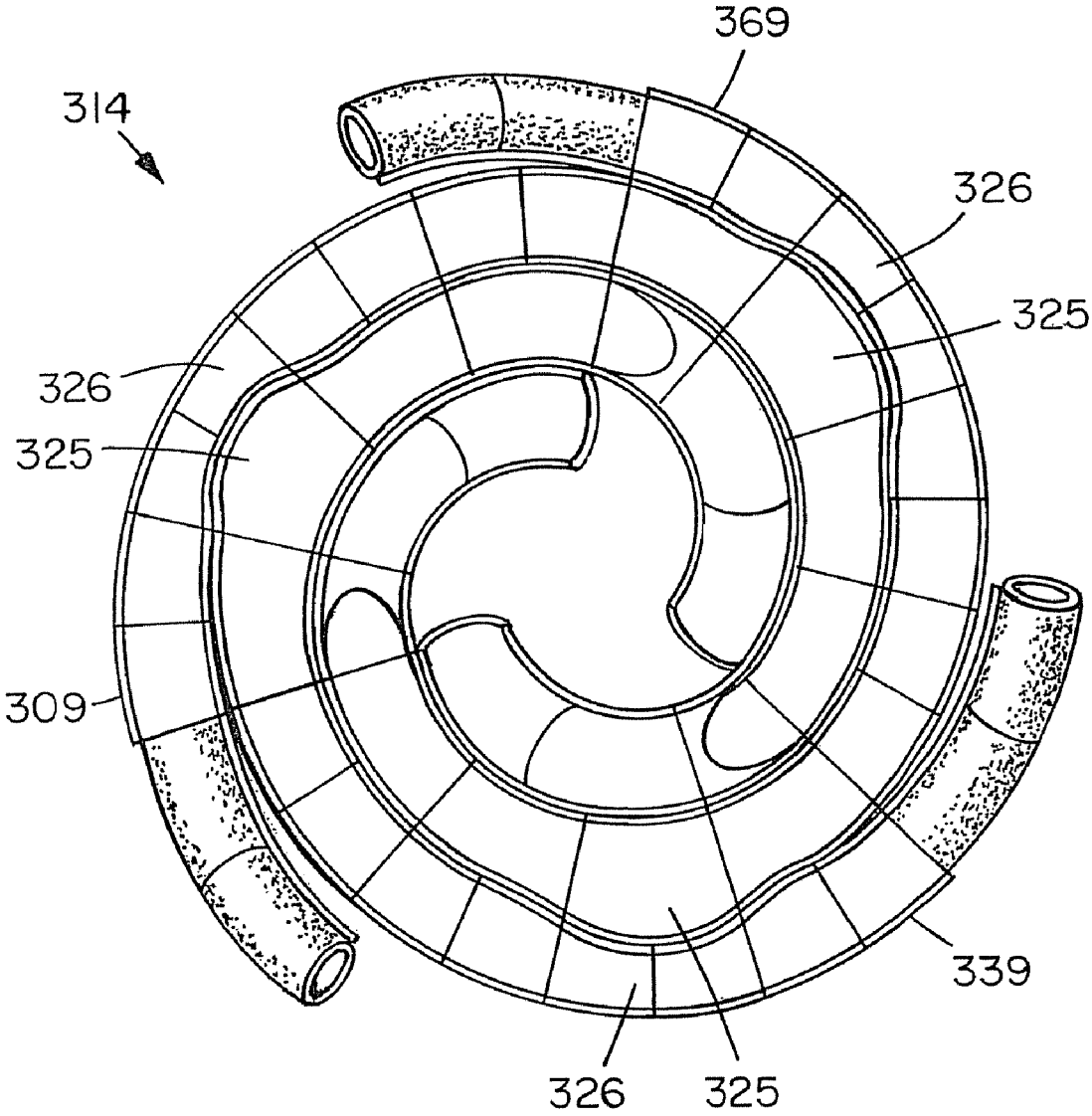
FIG. 13 is a top plan view of an eighth embodiment of a waterslide bowl, having three troughs with some sections having varying widths.

The trough may have some variations in width along its length. For example, sections of the trough may be wider or narrower than adjacent sections, for example to provide a feature in the trough adding interest to the ride. This can be done without materially affecting the nesting of laterally adjacent parts of the trough, for example by having a narrowing in one section fit next to a widening in a nesting section. The width W of the trough in embodiments with variations in width is accordingly to be considered as the width along the greater part of the trough length. This feature of width variations along the length of a trough also applies to the waterslide bowls having two or more troughs as described below and as illustrated in FIG. 13 in a three-trough bowl.

Figure 5:
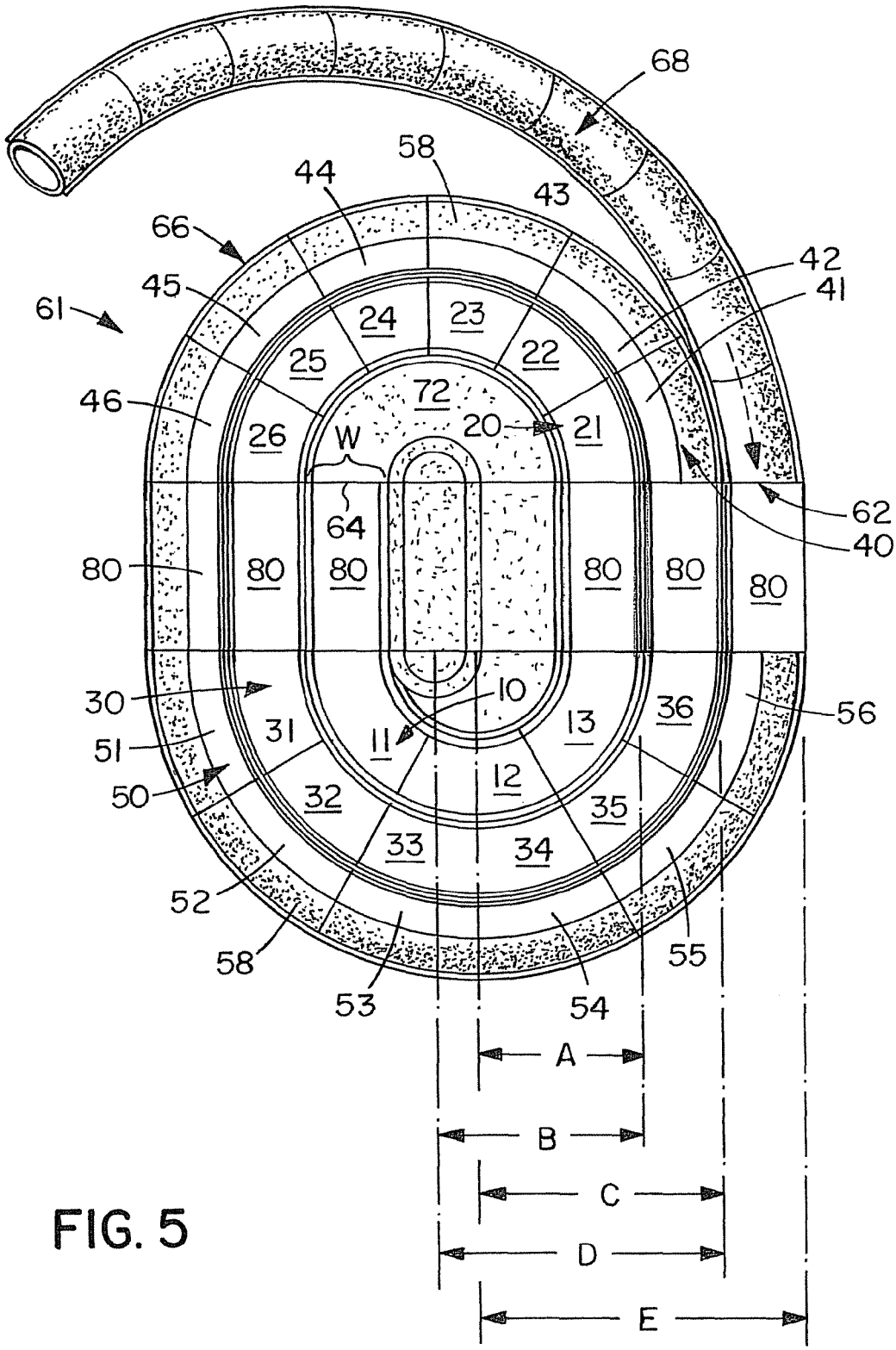
FIG. 5 is a top plan view of a second embodiment of a bowl with one trough, with straight trough sections.

The bowl can be in shapes other than circular. In a further embodiment of the bowl 61 shown in FIG. 5, straight trough sections 80 are positioned between the sets of semi-circular sections so the bowl has a racetrack shape (in plan view). The straight sections 80 may be substantially identical to each other in shape and size, so they can be made from one mold. Further straight sections can be included at other locations in the trough to form a bowl having other shapes, for example rectangular with rounded corners. The invention includes bowls having straight sections positioned between curved sections in various combinations and configurations, whereby the nesting troughs form bowls having a variety of shapes.

Two-Trough Bowls

Figure 6:
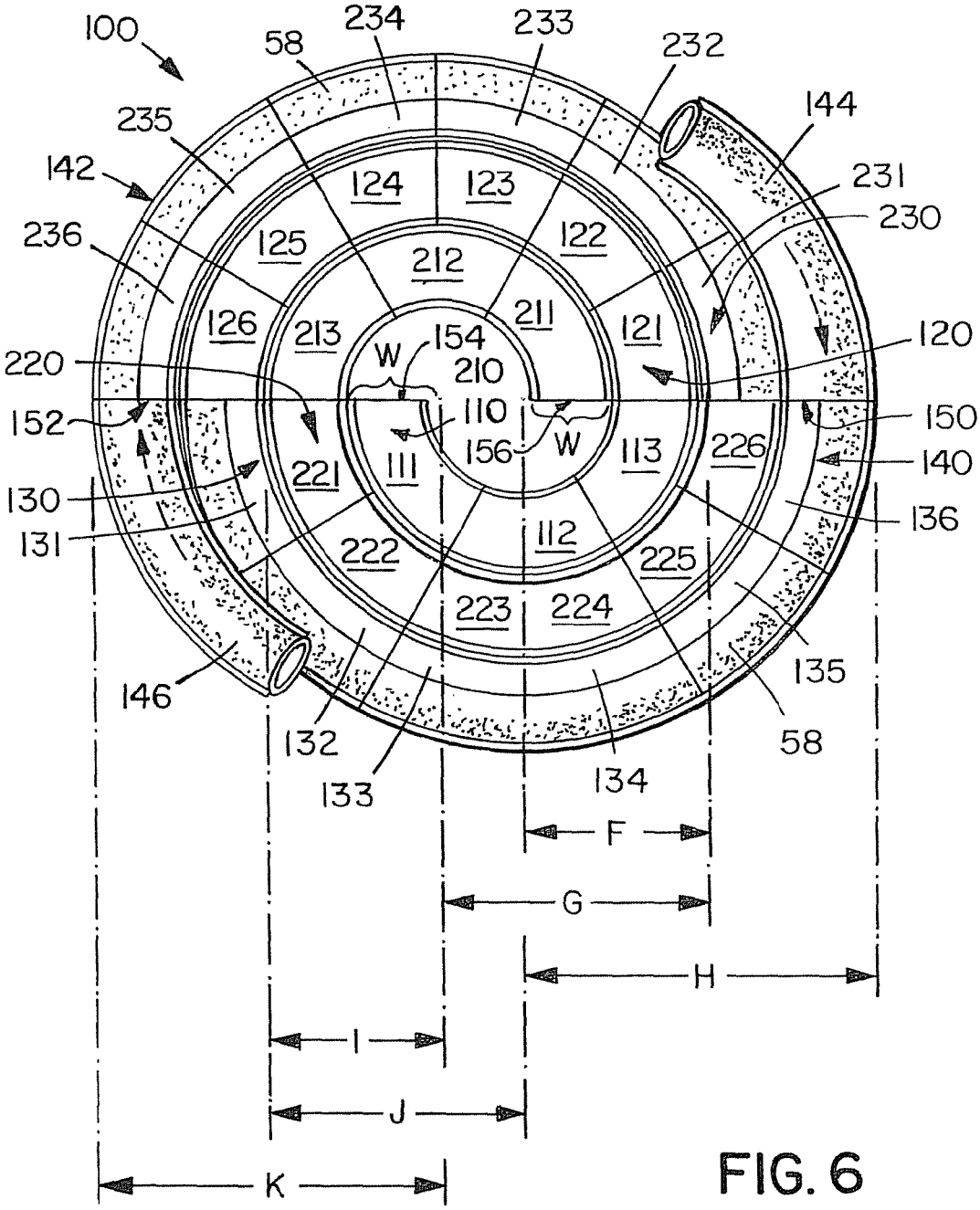
FIG. 6 is a top plan view of a third embodiment of a waterslide bowl, having two troughs.
Figure 7:
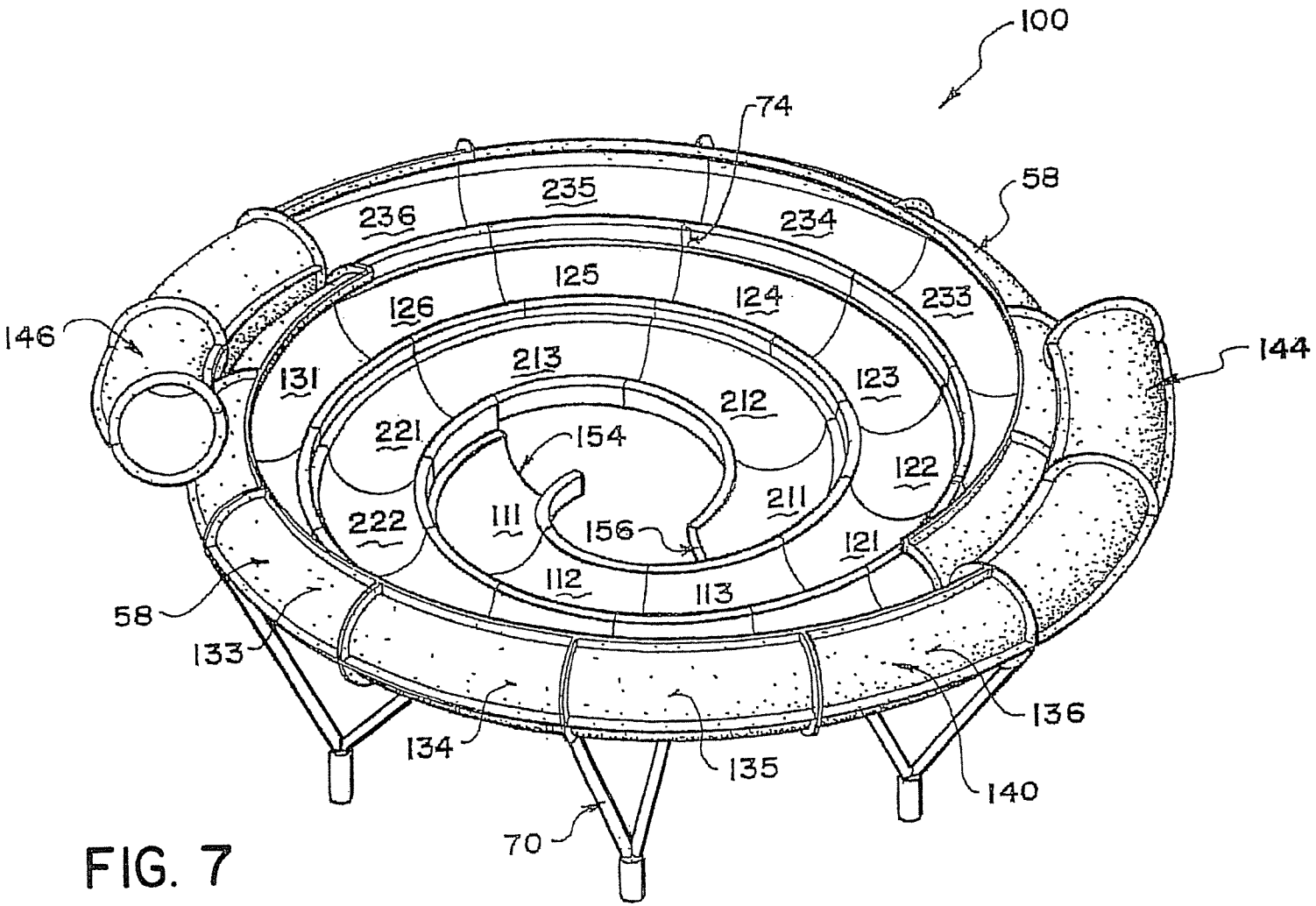
FIG. 7 is a perspective view of the waterslide bowl of FIG. 6.

In a further embodiment of the invention, shown in FIGS. 6 and 7, a waterslide bowl 100 comprises two nesting troughs. The waterslide bowl 100 has two rider entrances 150, 152 and two rider exits 154, 156. A first trough 140 extends in a continuous, curved path between one entrance 150 and one exit 154, and a second trough 142 extends between the other entrance 152 and other exit 156, the two troughs 140, 142 nesting together, as described below, and forming the rider surfaces of the bowl 100. The paths defined by the two troughs descend from a relatively higher elevation at the entrances 150, 152 to a relatively lower elevation at the exits 154, 156. A flume 144 is affixed at one rider entrance 150 and a second flume 146 is affixed at the other rider entrance 152. The bowl 100 can be ridden in by two riders at the same time, each rider being in his or her own trough 140 or 142.

The first trough 140 is made of three sets 110, 120, 130 of individual trough sections. The first set 110 is the innermost set, being adjacent to and leading into the first rider exit 154. It comprises three trough sections 111, 112 and 113. Each trough section is an individual component, the sections being affixed together to form a set. All of the trough sections of the bowl 100 have the same width, designated W in FIG. 6. The set 110 of trough sections 111, 112 and 113 forms a half-circle which has a radius designated F in FIG. 6.

The second set 120 of trough sections continues the first trough outwardly in the bowl from the first set 110, and comprises six trough sections 121, 122, 123, 124, 125 and 126. This set 120 forms a half-circle which has a radius designated G in FIG. 6. The radius G is longer than the radius F by a distance of W.

The third set 130 of trough sections continues the trough 140 outwardly in the bowl 100 from the second set 120, and comprises six trough sections 131, 132, 133, 134, 135 and 136. This set 130 forms a half-circle which has a radius designated H in FIG. 6. The radius H is longer than the radius G by a distance of W.

It will be apparent that the configuration of the first trough 140, by reason of the relationship between the respective radii of the three sets 110, 120 and 130, forms a space in which the second trough 142, identical in configuration to the first trough 140, can interfit in a nesting, side-by-side arrangement, with the first trough.

The second trough 142 comprises three sets 210, 220, 230 of individual trough sections. The first set 210 is the innermost, being adjacent to and leading into the second rider exit 156. It comprises three trough sections 211, 212 and 213. This set 210 forms a half-circle which has a radius I, this radius I being the same as the radius F of the half-circle formed by the trough set 110.

The second set 220 of trough sections of the second trough 142 continues the trough outwardly in the bowl from the first set 210 and comprises six trough sections 221, 222, 223, 224, 225 and 226. This set 220 forms a half-circle which has a radius J, this radius J being the same as the radius G of the half-circle formed by the trough set 120. Accordingly, the radius J is longer than the radius I by a distance of W.

The third set 230 of trough sections continues the second trough 142 outwardly in the bowl 100 from the second set 220 and comprises six trough sections 231, 232, 233, 234, 235 and 236. This set 230 of trough sections forms a half-circle which has a radius K, this radius K being the same as the radius H of the half-circle formed by the set 130 of trough sections. Accordingly, the radius K is longer than the radius J by a distance of W.

The trough sections of a given set are substantially identical to each other in size and shape. Thus, each of the trough sections 111, 112 and 113 are the same as each other, and also the same as each of the trough sections 211, 212 and 213; and so on for the other sets. As a result, the riding surface of the two troughs can be made from only three different shapes of trough sections.

As with the first embodiment of the waterslide bowl 60, the bowl 100 can be made larger or smaller than the illustrated bowl, and the rider entrances and exits can be located at any selected radial positions.

The troughs 140, 142 may have some variations in width along their length, in the manner of the width variations explained above in respect of the one-trough bowl.

Figure 8:
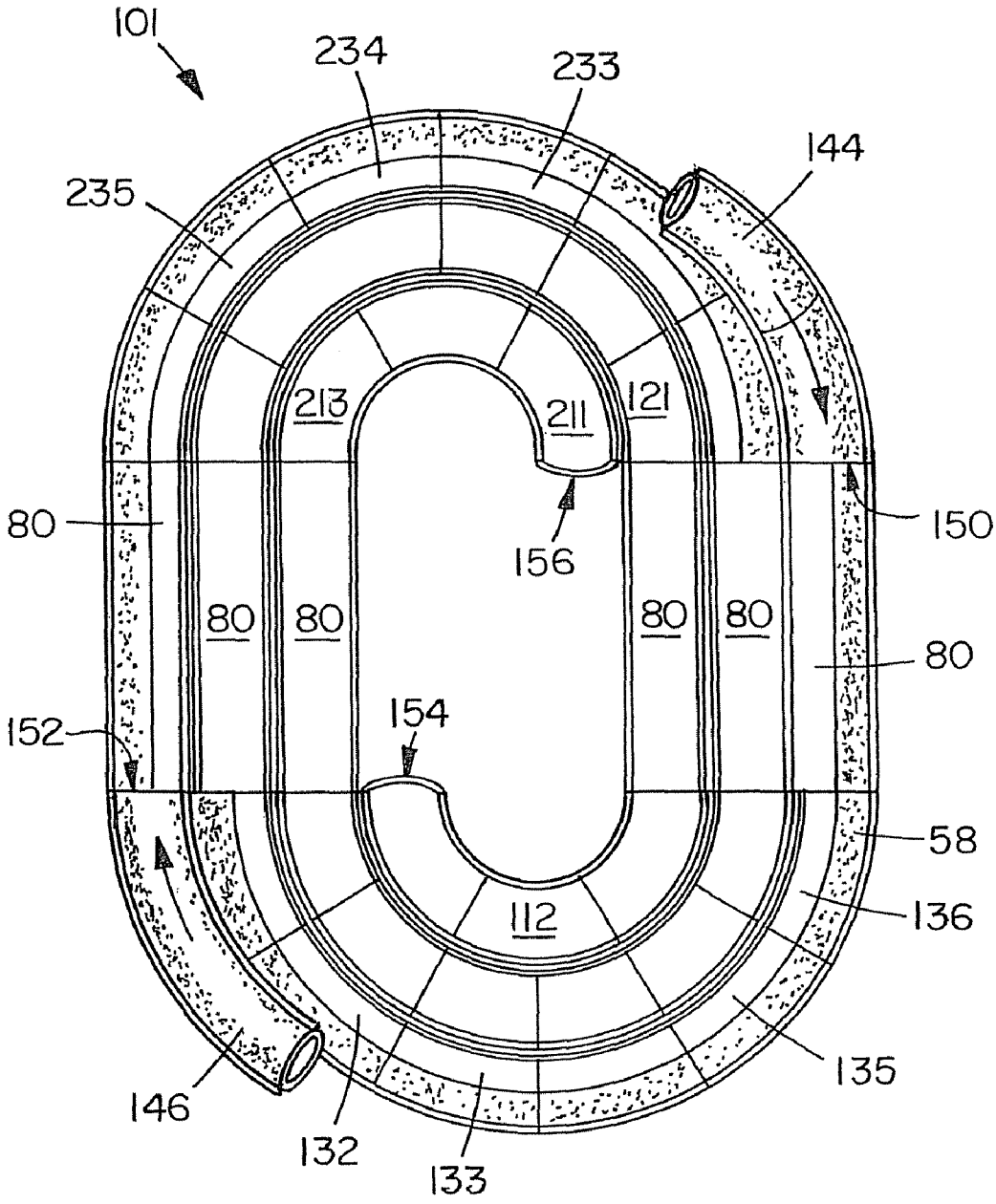
FIG. 8 is a top plan view of a fourth embodiment of a waterslide bowl, having two troughs with straight sections.
Figure 9:
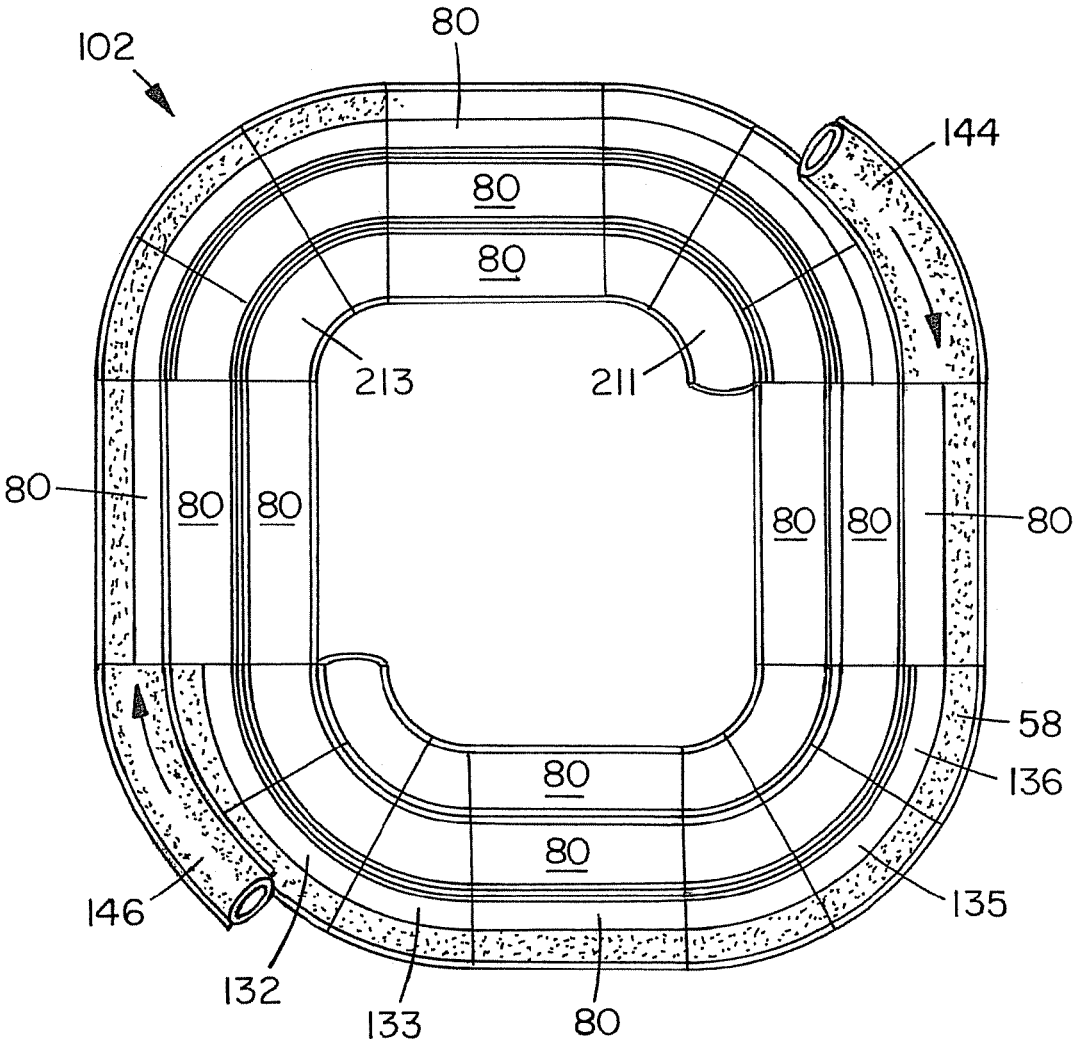
FIG. 9 is a top plan view of a fifth embodiment of a waterslide bowl, having two troughs with straight sections.

Again as with the one-trough bowls, the two-trough bowl can be in shapes other than circular. In a further embodiment of the bowl 101, shown in FIG. 8, straight trough sections 80 are positioned between the sets of semi-circular sections, forming a racetrack-shaped bowl. In another embodiment of the bowl 102, shown in FIG. 9, the bowl additionally has straight sections 80 inserted at the mid-point of the sets, forming a bowl that is generally rectangular with rounded corners.

Figure 10:
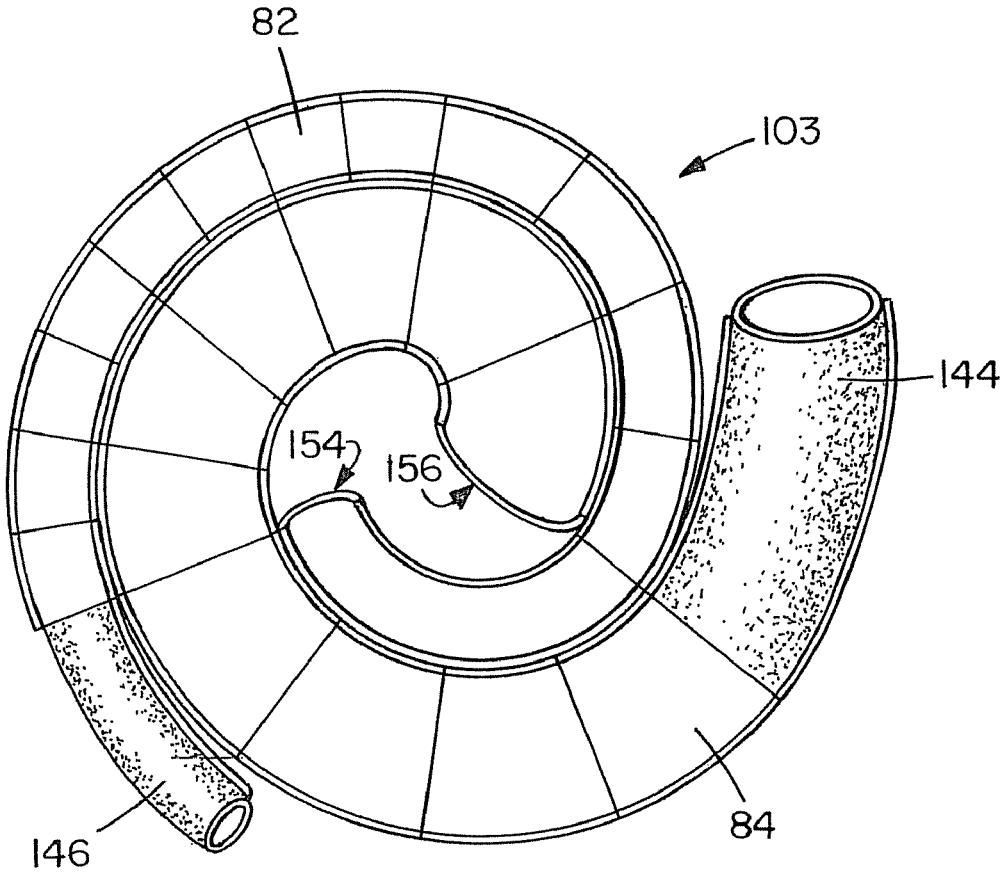
FIG. 10 is a top plan view of a sixth embodiment of a waterslide bowl, having two troughs of different widths.

The invention includes bowls having two (or more) troughs in which the troughs have different widths. Referring to FIG. 10, the bowl 103 comprises two nesting troughs 82, 84, the width of trough 84 being greater than the width of trough 82.

Three-Trough Bowls

Figure 11:
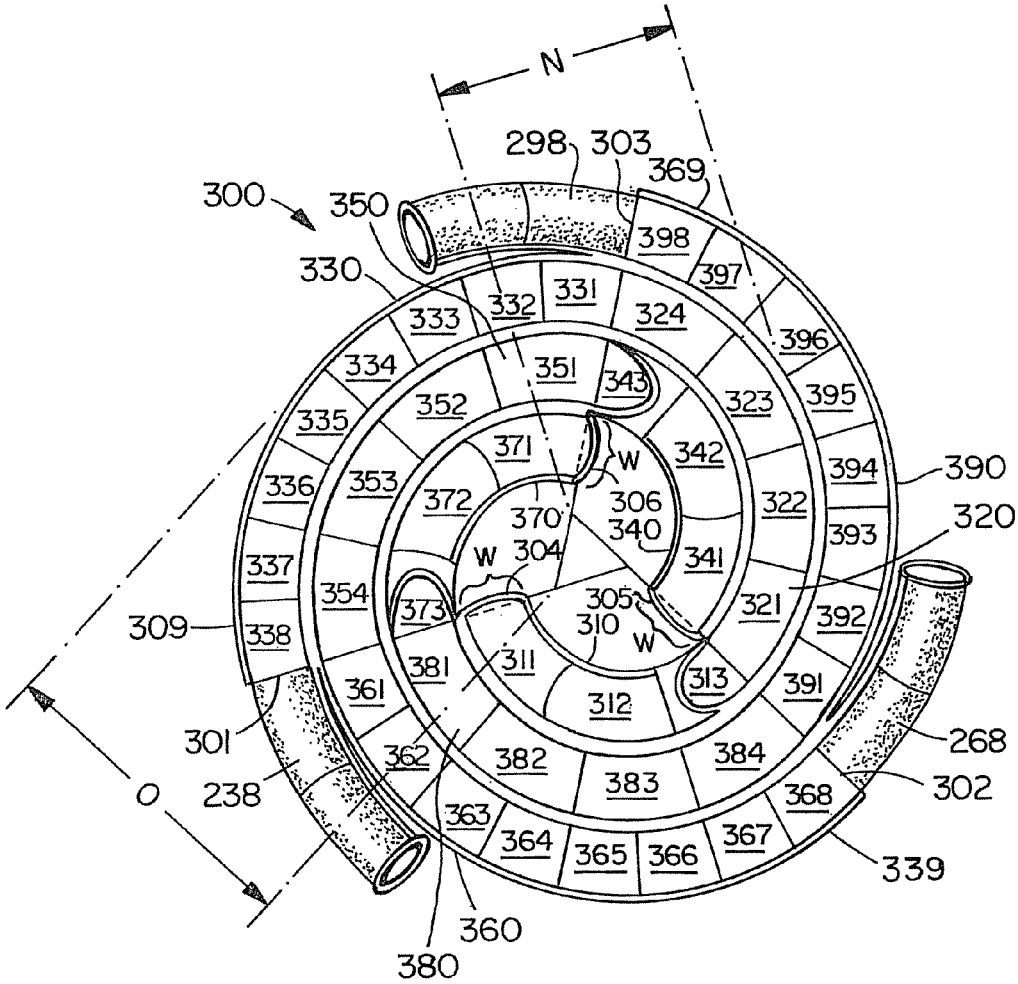
FIG. 11 is a top plan view of a seventh embodiment of a waterslide bowl, having three troughs.
Figure 12:
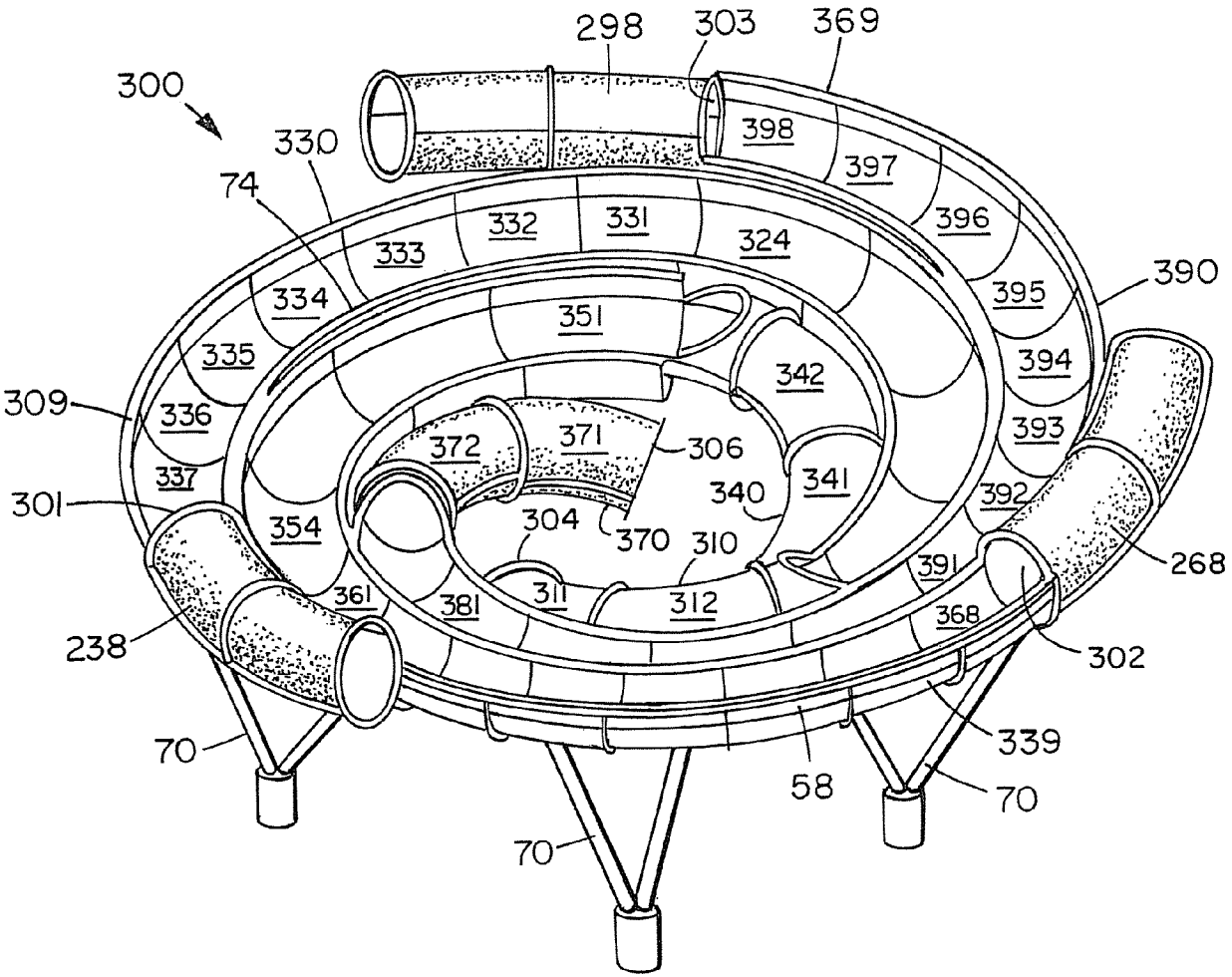
FIG. 12 is a perspective view of the bowl of FIG. 11.

Referring next to FIGS. 11 to 12, the waterslide bowl 300 comprises three nesting troughs 309, 339 and 369, each with a respective rider entrance 301, 302 and 303 and respective rider exit 304, 305 and 306. The first trough 309 extends in a continuous curved path between one rider entrance 301 and one exit 304. The second trough 339 extends in a continuous curved path between the second rider entrance 302 and the second exit 305. The third trough 369 extends in a continuous curved path between the third rider entrance 303 and the third rider exit 306. The three troughs 309, 339 and 369 nest together, as described below, and form the rider surface of the bowl 300. A flume 238 is affixed at the first rider entrance 301, a second flume 268 at the second rider entrance 302 and a third flume 298 at the third rider entrance 303. The bowl 300 can be ridden in by three riders at the same time, each in his or her own trough.

The first trough 309 is made of two sets 320, 330 of individual trough sections. A covered run-out tube 310 connects to the set 320 to guide the rider to the rider exit 304. This run-out tube comprises sections 311, 312 and 313. The run-out tube 310 and all of the trough sections of the bowl have the same width, designated W in FIG. 11.

The first set 320 of trough sections is adjacent to and continues the first trough 309 outwardly in the bowl from the run-out tube 310, and comprises four trough sections 321, 322, 323 and 324. This set 320 forms one-third of a circle which has a radius designated N in FIG. 11.

The second set 330 of trough sections is adjacent to and continues the trough 309 outwardly in the bowl 300 from the first set 320. It comprises eight trough sections 331, 332, 333, 334, 335, 336, 337 and 338. This set forms one-third of a circle which has a radius O. The radius O is longer than the radius N by a distance of W.

It will be apparent that the configuration of the first trough 309, by reason of the relationship between the respective radii of the two sets 320 and 330, forms a space in which the second and third troughs 339, 369, identical in configuration to the first trough 309, can interfit in a nesting, side-by-side arrangement, with the first trough and each other.

The second trough 339 comprises two sets 350 and 360 of individual trough sections. A covered run-out tube 340 connects to the set 350 and comprises sections 341, 342 and 343.

The first set 350 of trough sections of the second trough 339 continues the trough outwardly in the bowl from the run-out tube 340 and comprises four trough sections 351, 352, 353 and 354. This set 350 forms one-third of a circle which has a radius N, being the same as the radius N of the one-third circle formed by the trough set 320.

The second set 360 of trough sections of the second trough 339 continues the trough outwardly in the bowl from the first set 350 and comprises eight trough sections 361, 362, 363, 364, 365, 366, 367 and 368. This set forms one-third of a circle which has a radius O, being the same as the radius O formed by the set 330 of trough sections.

The third trough 369 comprises two sets 380 and 390 of individual trough sections. A covered run-out tube 370 connects to the set 380 and comprises sections 371, 372 and 373.

The first set 380 of trough sections of the third trough 369 continues the trough outwardly in the bowl from the run-out tube 370. It comprises four trough sections 381, 382, 383 and 384. This set 380 forms one-third of a circle which has a radius N, being the same as the radius N of the one-third circle formed by the trough sets 320 and 350.

The second set 390 of trough sections of the third trough 369 continues the trough outwardly in the bowl from the first set 380. It comprises eight trough sections 391, 392, 393, 394, 395, 396, 397 and 398. This set forms one-third of a circle which has a radius O, being the same as the radius O formed by the sets 330 and 360 of trough sections.

The trough sections of a given set are substantially identical to each other in size and shape. Thus, each of the trough sections 321, 322, 323 and 324 of the trough set 320 are the same as each other, and are also the same as each of the trough sections 351, 352, 353 and 354 of the set 350 and each of sections 381, 382, 383 and 383 of the set 380. Likewise, each of the sections of the trough sets 330, 360 and 390 are the same as each other. As a result, the riding surface of each of the troughs, and of the entire bowl, can be made from only two different shapes of trough sections (plus run-out tube sections).

An upwardly-extending side wall 58 is provided on the outer side of sets 330, 360 and 390 of the trough sections to retain the rider in the trough after entering the bowl.

It will be apparent that the waterslide bowl can be made larger or smaller than the illustrated bowl 300, providing a longer or shorter path about the bowl for a rider, by having more or fewer sets of trough sections. For example, the bowl could be made larger, providing a path one-third revolution longer around the bowl, by adding an additional set of trough sections to continue the path outward from trough sections 338, 368 and 398, the additional set forming a one-third circle with a radius longer than the radius O of the one-third circle formed by the sets 330, 360, 390 by a distance equal to W.

The modular construction of the bowl also permits the rider entrances and the rider exits of the bowl to be located at any selected radial position. For example, referring to the FIG. 11 orientation, the rider entrance of trough 309 could be located at the ten o'clock position rather than the eight o'clock position by omitting the outer four trough sections 335, 336, 337 and 338, and attaching the flume 238 to trough section 334.

The troughs 390, 339, 369 may have some variations in width along their length in the manner explained above in respect of the one- and two-trough bowls. Referring to FIG. 13, each of the troughs 309, 339, 369 of the bowl 314 has a portion 325 which may comprise one or more trough sections, which has a width greater than the width W of the rest of the trough sections, and a portion 326 which has a width less than the width W. These parts of different width fit next to each other so that the troughs can nest together despite these width variations.

Figure 14:
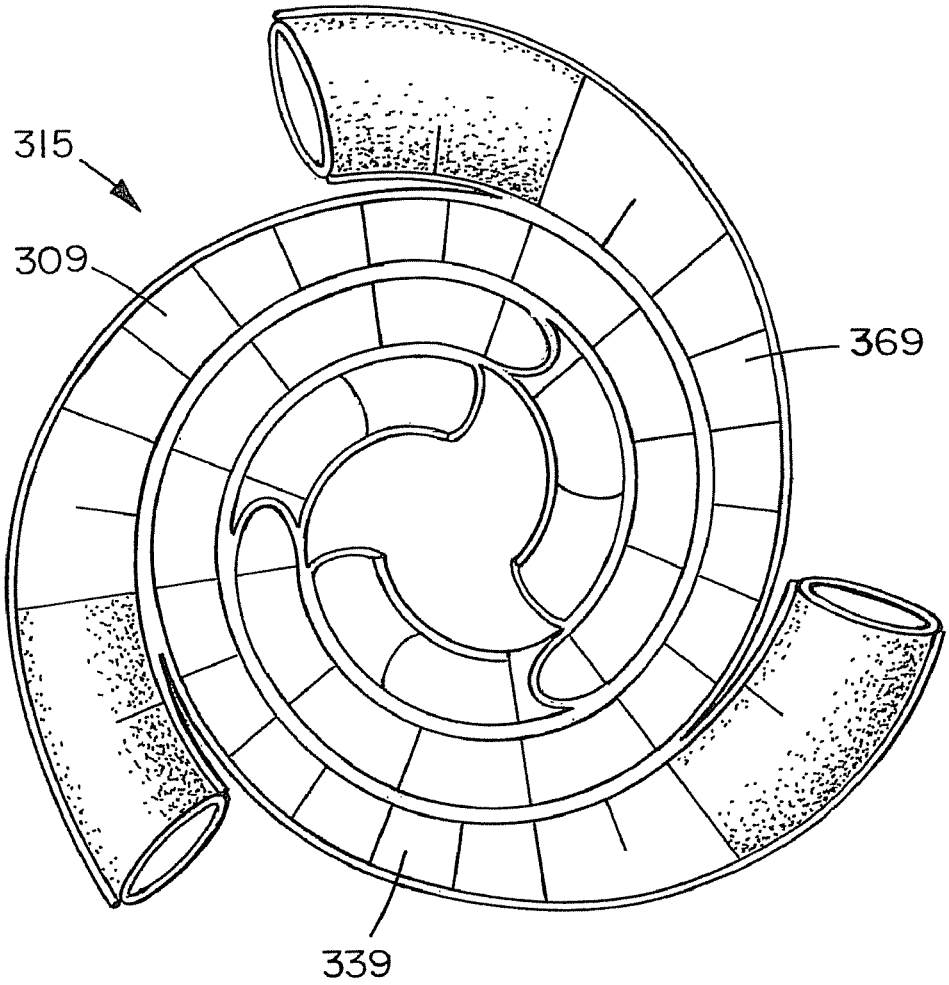
FIG. 14 is a top plan view of a ninth embodiment of a waterslide bowl, having three troughs whose width varies along their length.

The troughs may also have variations in width in a manner that does not include adjustment of the width of a nesting trough. For example, as shown in FIG. 14, the waterslide bowl 315 has troughs 309, 339, 369 which have a greater width in the sections adjacent to their respective entrances than in the remainder of the troughs. The entrance sections nest against an adjacent trough on their inward side but not their outward side, allowing for expanded width in the outward direction. Similarly, the sections adjacent to the rider exits can have a greater width by flaring in a radially inward direction without interfering with the nesting of adjacent troughs, or the sections adjacent to the rider exits may narrow or taper.

Four-Trough Bowls

Figure 15:
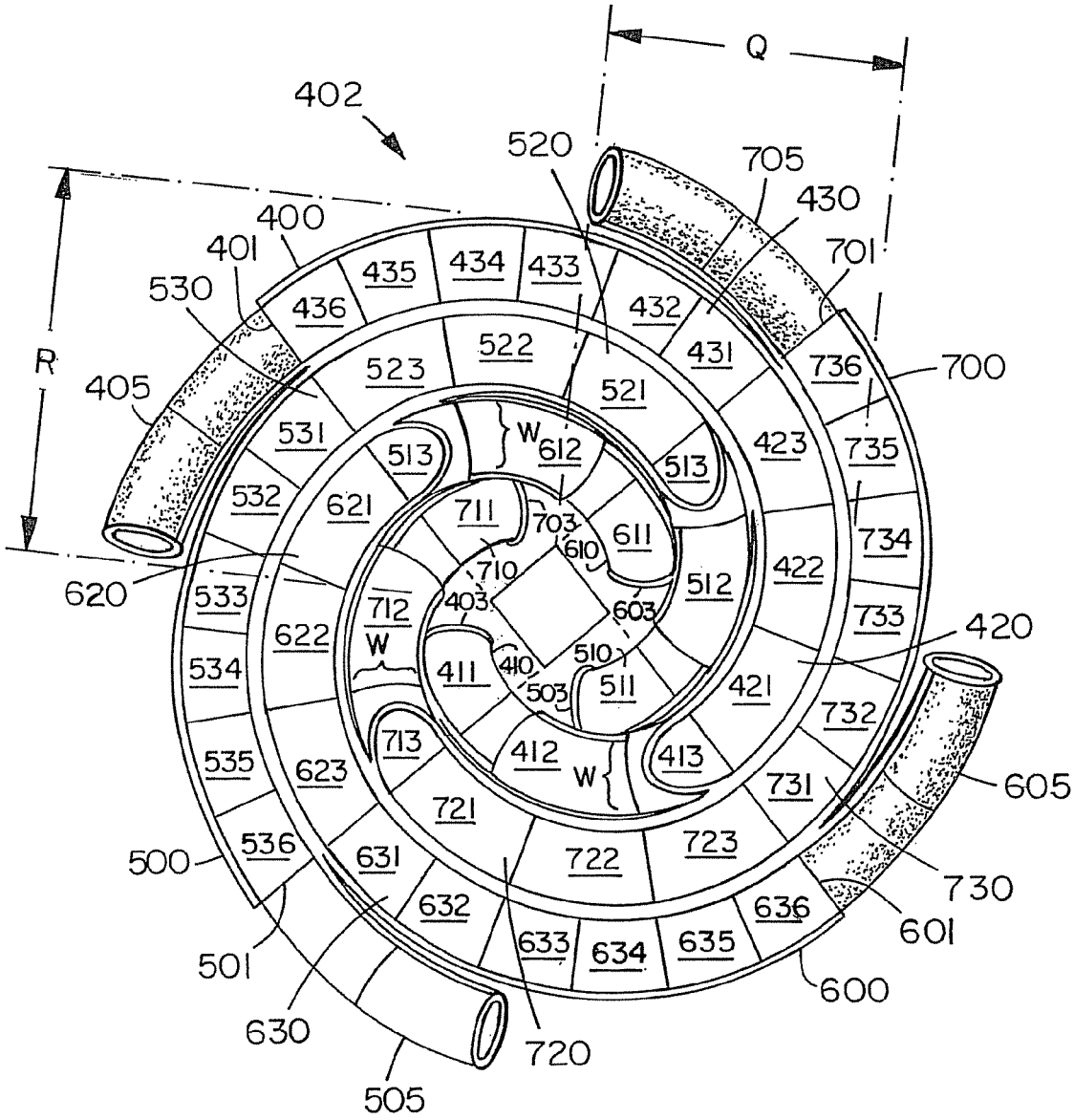
FIG. 15 is a top plan view of a tenth embodiment of a waterslide bowl, having four troughs.
Figure 16:
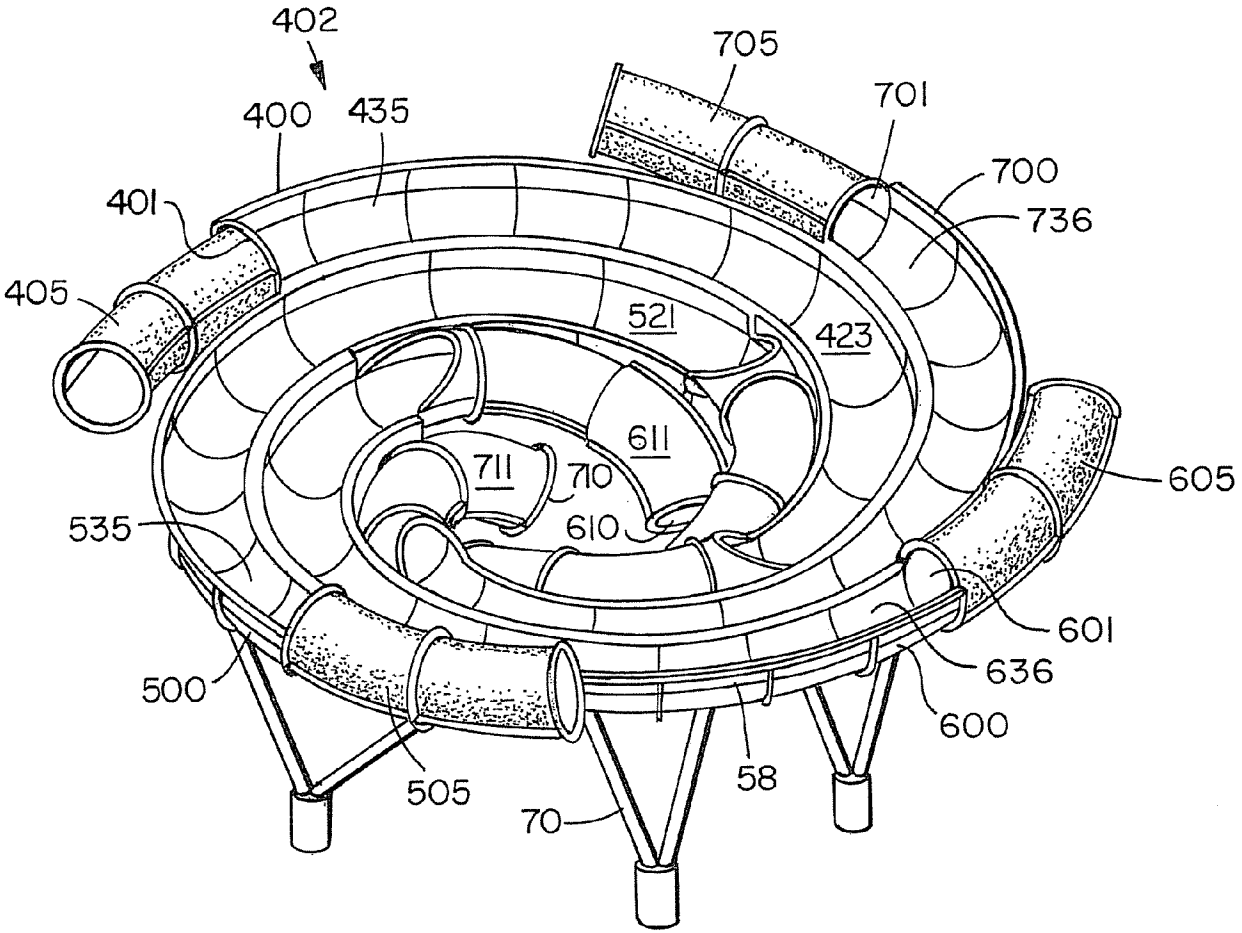
FIG. 16 is a perspective view of the bowl of FIG. 15.

The waterslide bowl 402, shown in FIGS. 15 and 16, comprises four nesting troughs 400, 500, 600 and 700, each with a respective rider entrance 401, 501, 601 and 701 and respective rider exit 403, 503, 603 and 703. The first trough 400 extends in a continuous curved path between one rider entrance 401 and one exit 403. The second trough 500 extends in a continuous curved path between the second rider entrance 501 and the second exit 503. The third trough 600 extends in a continuous curved path between the third rider entrance 601 and the third rider exit 603. The fourth trough 700 extends in a continuous curved path between the fourth rider entrance 701 and the fourth rider exit 703. The four troughs 400, 500, 600 and 700 nest together, as described below, and form the rider surface of the bowl 402. A flume 405 is affixed at the first rider entrance 401, a second flume 505 at the second rider entrance 501, a third flume 605 at the third rider entrance 601 and a fourth flume 705 at the fourth rider entrance 701.

The first trough 400 is made of two sets 420, 430 of individual trough sections. A covered run-out tube comprises sections 411, 412 and 413 and guides the rider to an exit 401. The run-out tube and all of the trough sections of the bowl have the same width, designated W in FIG. 15.

The first set 420 of trough sections is adjacent to and continues the first trough 400 outwardly in the bowl from the tube 410, and comprises three trough sections 421, 422 and 423. This set 420 forms one-fourth of a circle which has a radius designated Q in FIG. 15.

The second set 430 of trough sections continues the trough 400 outwardly in the bowl 402 from the first set 420. It comprises six trough sections 431, 432, 433, 434, 435 and 436. This set forms one-fourth of a circle which has a radius R. The radius R is longer than the radius Q by a distance of W.

It will be apparent that the configuration of the first trough 400, by reason of the relationship between the respective radii of the two sets 420 and 430, forms a space in which the second, third and fourth troughs 500, 600, 700, identical in configuration to the first trough 400, can interfit in a nesting, side-by-side arrangement, with the first trough and each other.

The second trough 500 comprises two sets 520 and 530 of individual trough sections. A covered run-out tube comprises sections 511, 512 and 513.

The first set 520 of trough sections of the second trough 500 continues the trough outwardly in the bowl from the run-out tube 510 and comprises three trough sections 521, 522 and 353. This set 520 forms one-fourth of a circle which has a radius Q, being the same as the radius Q of the one-fourth circle formed by the trough set 420.

The second set 530 of trough sections of the second trough 500 continues the trough outwardly at the bowl from the first set 520 and comprises six trough sections 531, 532, 533, 534, 535 and 536. This set forms one-fourth of a circle which has a radius R, being the same as the radius R formed by the set 430 of trough sections.

The third trough 600 comprises two sets 620 and 630 of individual trough sections. A covered run-out tube comprises sections 611, 612 and 613.

The first set 620 of trough sections of the third trough 600 continues the trough outwardly in the bowl from the run-out tube 610. It comprises three trough sections 621, 622 and 623. This set 620 forms one-fourth of a circle which has a radius Q, being the same as the radius Q of the one-fourth circle formed by the trough sets 420 and 520.

The second set 630 of trough sections of the third trough 600 continues the trough outwardly in the bowl from the first set 620. It comprises six trough sections 631, 632, 633, 634, 635 and 636. This set forms one-fourth of a circle which has a radius R, being the same as the radius R formed by the sets 430 and 530 of trough sections.

The fourth trough 700 comprises two sets 720 and 730 of individual trough sections. A covered run-out tube 710 comprises sections 711, 712 and 713.

The first set 720 of trough sections of the fourth trough 700 continues the trough outwardly in the bowl from the run-out tube 710. It comprises three trough sections 721, 722 and 723. This set 720 forms one-fourth of a circle which has a radius Q, being the same as the radius Q of the one-fourth circle formed by the trough sets 420, 520 and 620.

The second set 730 of trough sections of the third trough 700 continues the trough outwardly in the bowl from the first set 720. It comprises six trough sections 731, 732, 733, 734, 735 and 736. This set forms one-fourth of a circle which has a radius R, being the same as the radius R formed by the sets 430, 530 and 630 of trough sections.

The trough sections of a given set are substantially identical to each other in size and shape. Thus, each of the trough sections 421, 422 and 423 of the trough set 420 are the same as each other, and are also the same as each of the trough sections 521, 522 and 523 of the set 520 and each of sections 621, 622 and 623 of the set 620 and each of sections 721, 722 and 723 of the set 720. Likewise, each of the sections of the trough sets 430, 530, 630 and 730 are the same as each other. As a result, the riding surface of each of the troughs, and of the entire bowl, can be made from only two different shapes of trough sections.

It will be apparent that the waterslide bowl can be made larger or smaller than the illustrated bowl 402, providing a longer or shorter path about the bowl for a rider, by having more or fewer sets of trough sections. For example, the bowl could be made larger, providing a path one-fourth revolution longer around the bowl, by adding an additional set of trough sections to continue the path outward from trough sections 436, 536, 636 and 736, the additional set forming a half-fourth circle with a radius longer than the radius R of the one-fourth circle formed by the sets 430, 530, 630 and 730 by a distance equal to W.

More than One Trough in a Single Section

Figure 17:
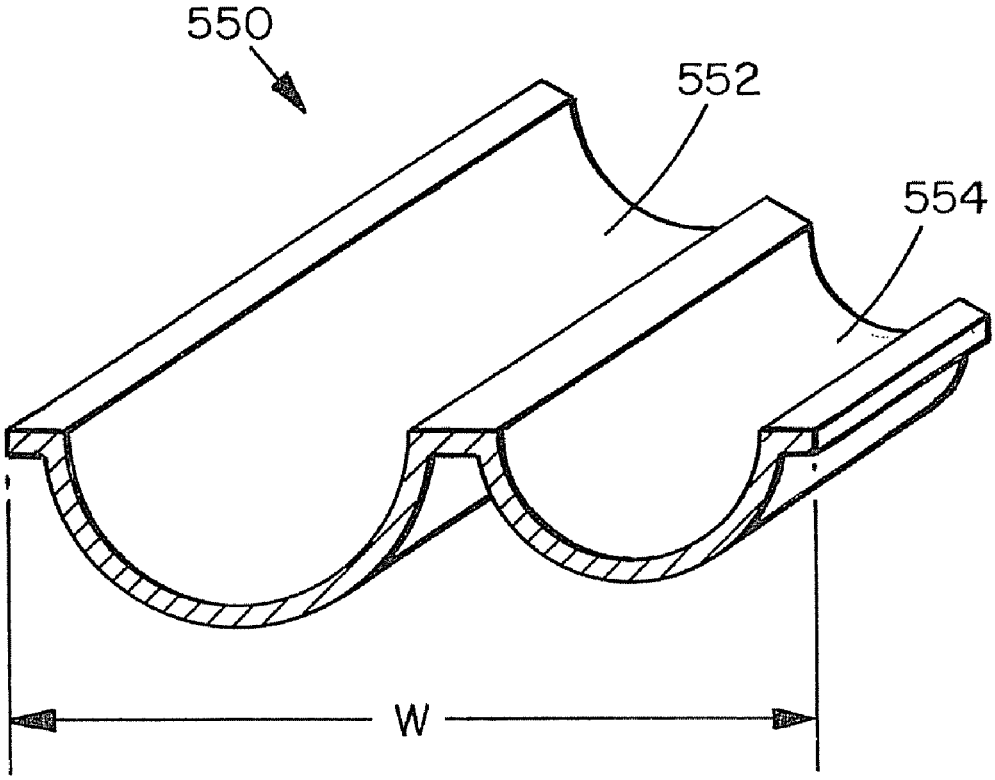
FIG. 17 is a perspective view of a trough section which comprises part of two troughs.

The trough sections described above comprise elements which attach together to form one trough. However, the invention includes waterslide bowls formed of trough sections in which part of two or more troughs (which may be of the same or different widths or profiles) are formed of a single section. As illustrated in FIG. 17, a trough section 550 is a single, unitary molded piece, forming a portion of two troughs. A first concave channel 552 forms part of one trough and a second concave channel 554 forms part of a second trough, the second trough being radially inward of the first trough in the assembled bowl. In the illustrated embodiment, one channel 552 is wider than the other channel 554, for forming adjacent troughs of different widths. Alternatively, the two channels may have the same width. The trough section 550 has an overall width W which is the sum of the widths of the two trough sections.

It will be apparent that trough sections 550 may be substituted in place of the single-channel trough sections described above with respect to bowls having one or more troughs, thereby doubling the number of troughs that comprise a bowl.

Inverted Bowls

The waterslide bowls of the invention include inverted bowls having a rider entrance at the center and a rider exit at the periphery, the center being at a higher elevation than the periphery. In effect, the inverted bowl is in the form of a convex mound.

Though not separately illustrated in the drawings, the inverted bowl embodiment may readily be understood by reference to the plan view of FIG. 1 and considering the opening 64 as the rider entrance and the opening 62 as the rider exit, the rider travelling counterclockwise along the trough 66 from the entrance, at a relatively higher elevation, to the exit, at a relatively lower elevation. The rider may arrive at the rider entrance by means of a flume leading from an upstream part of the waterslide apparatus.

Although the invention has been described in terms of specific embodiments, it is not intended that the invention be limited to these embodiments. Various modifications within the scope of the invention will be apparent to those skilled in the art. For example, the radius of the fraction of a circle formed by each successively outward set of trough sections can be larger than the radius of a respectively adjacent inward set by a distance that is greater than that dictated by the mathematical relationships described above; however, that results in spaces between radially-adjacent sets of trough sections rather than the snug nesting that results when the distance complies with the described mathematical relationships, which is the preferred configuration. The scope of the invention is defined by the claims that follow.

What is claimed is:

1. A waterslide bowl comprising a rider entrance, a rider exit and a trough to guide a rider from the entrance to the exit, the trough comprising a plurality of individual trough sections which connect to each other end-to-end to form the trough and which nest together in a side-by-side arrangement at least one of the individual trough sections being an inner trough section having a first radius and an inner side and an outer side, at least one of the individual trough sections being an outer trough section having a second radius and an inner side and an outer side, the inner side of the outer trough section extending around the outer side of the inner trough section, and the second radius being larger than the first radius.

2. A waterslide bowl according to claim 1, wherein the trough includes individual trough sections that comprise a set of trough sections that are substantially the same as each other.

3. A waterslide bowl according to claim 1, wherein the inner side of the outer trough section contacts the outer side of the inner trough section.

4. A waterslide bowl according to claim 1, wherein the inner trough section forms a portion of a circle and the outer trough section forms a portion of a circle.

5. A waterslide bowl according to claim 1, wherein the inner trough section is a covered section and the outer trough section is an uncovered section.

6. A waterslide bowl according to claim 1, wherein the outer trough section fits around and nests against the inner trough section.

7. A waterslide bowl according to claim 1, wherein the trough forms a spiral path.

8. A waterslide bowl comprising a trough to guide a rider in a fixed path from a rider entrance to a rider exit, the trough comprising a plurality of sets of trough sections, each set forming one half of a circle and having a respective radius, the plurality of sets comprising an inner set adjacent to the rider exit, an outer set adjacent to the rider entrance and one or more intermediate sets between the inner and outer sets, the radius of each set that is outward from the inner set being larger than the radius of a respectively adjacent inward set such that the fixed path is a continuous curved path, the trough sections nesting together in a side-by-side arrangement.

9. A waterslide bowl according to claim 8, wherein the fixed path is approximately spiral.

* * * * *